United States Patent [19]

Samuelson et al.

[11] Patent Number: 4,700,730

[45] Date of Patent: Oct. 20, 1987

[54] WALKER FOR A SMALL CHILD

[75] Inventors: John P. Samuelson, Fridley; Douglas A. Quast, Elk River, both of Minn.

[73] Assignee: Regents of the University of Minnesota, Minneapolis, Minn.

[21] Appl. No.: 815,580

[22] Filed: Jan. 2, 1986

[51] Int. Cl.[4] ..... A61H 3/04

[52] U.S. Cl. ..... 135/67; 297/5; 280/87.02 R; 272/70.3

[58] Field of Search ..... 135/67, 85; 280/47.12, 280/87.02 R, 87.02 W, 43.24; 272/70.3, 70.4; 297/5, 6

[56] References Cited

U.S. PATENT DOCUMENTS

| | | | |
|---|---|---|---|
| 1,527,239 | 2/1925 | Vaughan et al. . | |
| 2,244,869 | 6/1941 | Everest et al. | 135/47 |
| 2,683,461 | 7/1954 | Kinney | 135/45 |
| 2,708,473 | 5/1955 | Gable et al. | 135/67 |
| 2,738,830 | 3/1956 | Black | 155/22 |
| 2,792,052 | 5/1957 | Johannesen | 135/67 |
| 2,792,874 | 5/1957 | Sundberg | 272/70.4 |
| 2,847,057 | 8/1958 | Holcombe | 272/70.3 |
| 2,855,024 | 10/1958 | Robb | 155/22 |
| 3,002,761 | 10/1961 | Sundberg | 280/43.24 |
| 3,336,043 | 8/1967 | Boeye | 280/47.12 X |
| 3,840,034 | 10/1974 | Smith | 135/67 |
| 4,248,256 | 2/1981 | Thomas | 135/67 |
| 4,251,105 | 2/1981 | Barker | 135/67 X |
| 4,643,211 | 2/1987 | Morris | 297/6 |

FOREIGN PATENT DOCUMENTS

| | | | |
|---|---|---|---|
| 1491561 | 10/1969 | Fed. Rep. of Germany | 272/70.3 |
| 1330189 | 5/1963 | France | 272/70.3 |
| 1096547 | 12/1967 | United Kingdom | 135/67 |
| 2061118 | 5/1981 | United Kingdom | 297/5 |
| 2074033 | 1/1984 | United Kingdom | 135/67 |

*Primary Examiner*—Richard J. Johnson
*Attorney, Agent, or Firm*—Kinney & Lange

[57] ABSTRACT

The present invention is an improved therapeutic walker of the type having rear support posts and wheels mounted on the bottom of front support posts. A leg member is attached to each of the front posts so that the leg members and rear posts rest on the support surface and the wheels of the front posts are spaced from the support surface. Clamp bracket assemblies are provided for adjustably securing the leg members to the front support posts.

5 Claims, 4 Drawing Figures

WALKER FOR A SMALL CHILD

BACKGROUND OF THE INVENTION

1. Field of the Invention.

The present invention relates to an improved therapeutic walker, and more particularly is concerned with an improvement to prevent a walker from inadvertently sliding away from a patient during weight shifts in use, while retaining ease of use.

2. Description of the Prior Art.

Walkers are used to assist rehabilitation of patients during periods of convalescence and restoration of physical capabilities. A common walker frame includes a pair of rear support posts and wheels mounted on a pair of front support posts. A patient pushes slightly up and forward on a handle, thereby redistributing the weight of the walker to the wheels, causing the rear support posts to leave the ground and the walker to roll forward. When the patient releases the handle, the rear posts return to the ground and the walker is stopped.

Particularly in small children, a walker has a tendency to slide out from beneath a child. Children have a propensity to lean their weight forward on a walker rather than lifting up on the handle. Leaning on the walker redistributes a child's weight from the back posts to the front wheels. When the weight is supplied at a sufficient angle the frictional force from the back posts is no longer large enough to prevent slipping. As the walker moves away from a child, the child may fall and cause injury to himself or herself or to others.

Consequently, a need exists for improvements in a walker of the type having rear posts and wheels on the front posts so that the walker will not roll away from a patient when the patient's weight is redistributed from the rear posts to the wheels.

SUMMARY OF THE INVENTION

The present invention provides an improvement in a walker of the type having rear posts and wheels mounted on the bottom of front posts to prevent the walker from sliding away from a patient. The device made according to the present invention can be installed on an existing walker without modification to the walker.

An extra, short support leg is attached to each front post in position so that the wheels on the front posts are only slightly spaced from the support surface when the walker is in the rest position with the rear posts on the support surface. When a patient lifts up on the walker handle, the walker tilts on the support legs and the wheels engage the support surface. The patient has to be balanced and no weight can be on the walker because a lifting action is needed. Then the walker can be easily rolled forward without difficulty and the patient will not easily lose balance. When the walker has been moved forward the patient's weight will be shifted and the patient will be supported by the rear posts and support legs. The wheels will not be effective and the walker is very stable.

The support legs are adjustably mounted to the front posts so that the support leg may be positioned where desired on the front post and may later be removed if desired. The adjustability permits spacing the wheels from the support surface a desired amount.

The device does not interfere with the motion of a patient's legs and it does not extend in front of or to the sides of the walker, thereby eliminating the chance of inadvertently hitting obstacles when the additional support legs are installed.

DETAILED DESCRIPTION OF THE PREFERRED EMBODIMENTS

Figure 1:
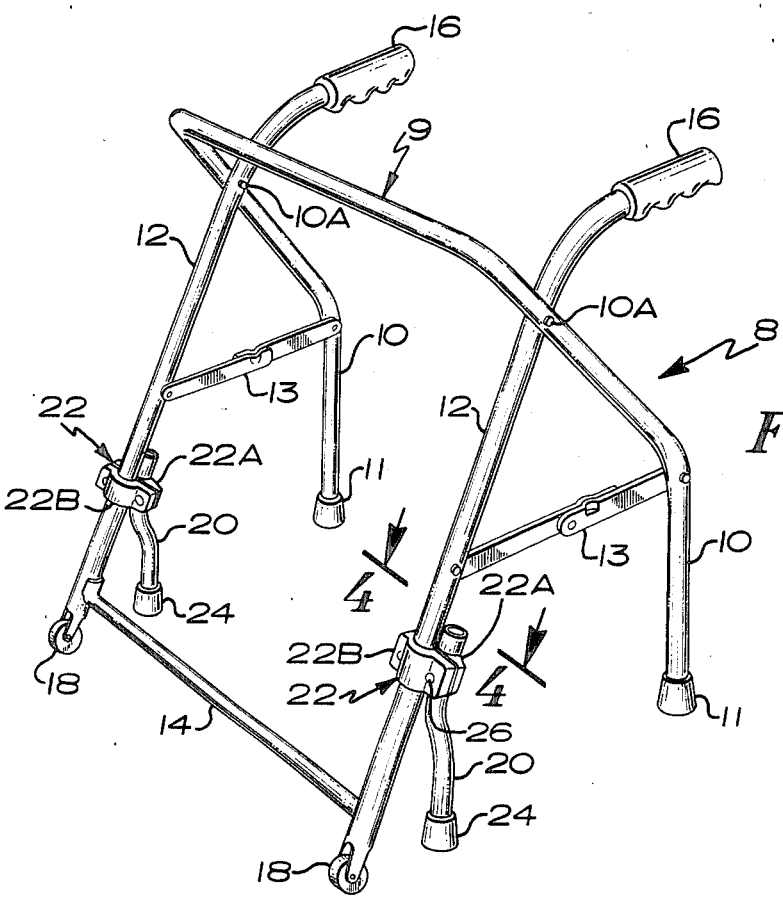
FIG. 1 is a perspective view of a walker having front auxilary support legs of the present invention mounted thereon.
Figure 4:
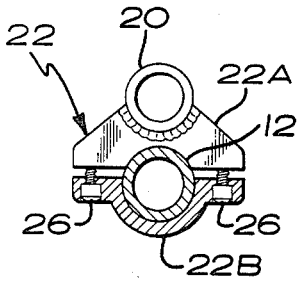
FIG. 4 is a sectional view taken along line 4—4 in FIG. 1.
Figure 3:
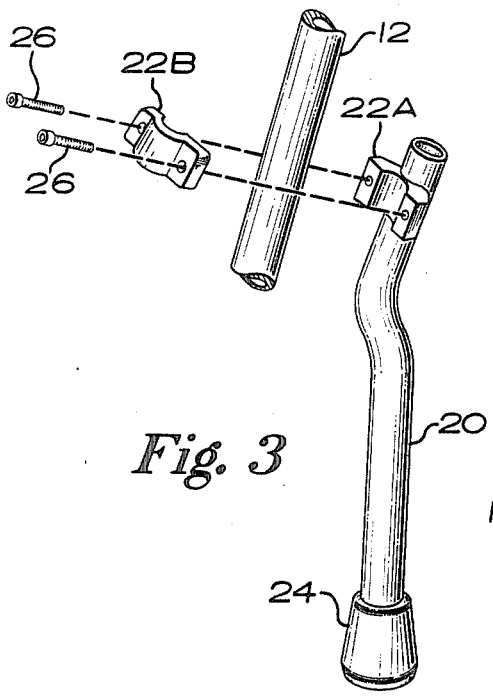
FIG. 3 is a fragmentary exploded perspective view of a support leg and a bracket assembly made according to the present invention.

A walker 8 having the improvement of the present invention thereon is shown in FIG. 1. The front posts 12,12 and the rear posts 10,10 of the "U" frame 9 form an open center, four post walker of conventional design. The U-shaped frame member 9 terminates in a pair of rear posts or legs 10,10. A separate front post 12 is pivotally connected to each leg or post 10 with a bolt 10A. Each front post 12 extends rearwardly and terminates at its upper end in a handle 16. Each front post 12 has a wheel 18 mounted on its bottom end.

In a conventional walker, the weight of the walker 8 and the patient is supported by the rear posts 10,10 and wheels 18,18 on front posts 12,12. Folding braces 13,13 provide stability between the front 12,12 and rear 10,10 posts and permit the walker 8 to be folded for storage and transportation.

A cross member 14 is fixed to and extends between the front posts 12,12 to reinforce the walker and provide stability. A rubber crutch tip 11 is placed on the end of each rear post 10 to provide a frictional surface and reduce the likelihood of the walker sliding on the support surface 7. The wheels 18,18 cause the walker 8 to roll forward when a patient lifts upwardly on the handles 16,16. By lifting upwardly, the crutch tips 11,11 clear the support surface 7 so that the walker rolls easily away from a patient.

Figure 2:
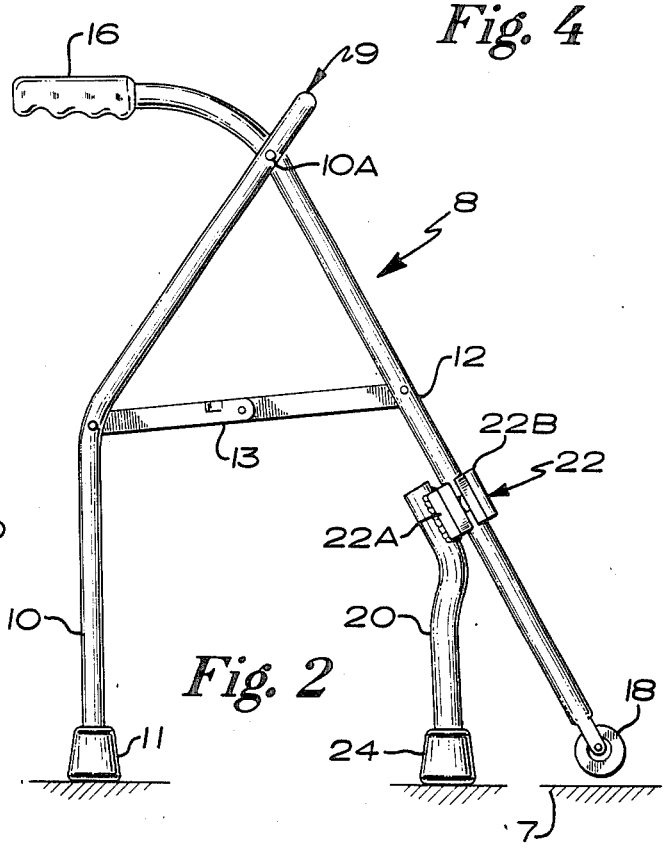
FIG. 2 is a side elevational view of the device of FIG. 1.

The present invention includes a pair of auxilary support legs 20,20 to hold the wheels 18,18 out of contact with the support surface 7 when the walker 8 is in the rest position. As shown in FIG. 2, a separate auxiliary support leg 20 is attached to each front post 12 and positioned to the rear of and in fore and aft alignment with the associated post 12 and rear post 10. The support leg 20 does not extend in front of the walker 8 nor to the sides of the walker 8. This placement prevents the support legs 20,20 from inadvertently hitting obstacles.

Each support leg 20 is attached to the front post 12 at a point below the folding brace 13 with a bracket assembly 22. The bracket assembly 22 is a clamp which has a first section 22A fixed near the upper end of the respective support leg 20 by means such as welding. The outer surface of the first clamp section 22A has a concave groove for receiving a front post 12. A second clamp section 22B has a concave groove on one surface for partially receiving a front post 12. The second clamp section 22B is placed over a front post 12 and secured to the first section 22A by cap screws 26,26. The screws 26,26 pass through openings in the second clamp section 22B and are threaded into openings in the first clamp section 22A.

The top portion of each support leg 20 is bent to be parallel with each front post 12 and the lower portion extends substantially straight down and is spaced rearwardly of the wheel 18 a desired amount. The lower portion of each support leg 20 is curved away from the respective front post 12.

When the auxiliary legs 20,20 are installed they are located to hold the wheels 18,18 slightly spaced above the support surface 7, as shown in FIG. 2. This spacing of the wheels 18,18 as well as the spacing rearwardly of the legs 20,20 is selected so that when a patient lifts up on the handles 16,16 the walker 8 tilts forward by pivoting on the support legs 20,20. A slight further lifting on the handle lifts legs 20,20 from the support surface 7 so that the walker 8 can be easily rolled forward.

As soon as a downward force is placed on the handles 16,16, the posts 10,10 and legs 20,20 immediately again rest on the support surface 7 to provide a very stable support that will not easily shift.

The support legs 20,20 are made of a strong and lightweight material such as aluminum so that the device will withstand normal use from children and other patients. It is desirable to provide crutch tips 24,24 on the bottoms of the support legs 20,20 to prevent the support legs 20,20 from sliding along the support surface 7.

The clamp bracket assembly 22 is constructed so that the leg supports 20,20 may be attached at any desired location on the front posts 12,12 so long as the wheels 18,18 are not in contact with the support surface 7 after installation. The closer the bracket assembly 22 is installed to the support surface 7, the greater the distance between the wheels 18,18 and the support surface 7. In practice, a distance of approximately $\frac{1}{8}$ inch between the wheels 18,18 and the support surface 7 is satisfactory for a small child. However, the clamp bracket assembly 22 may be adjusted along the front post 12 to meet the height and distance requirements of an individual patient. The clamp bracket assemblies 22,22 may later be disassembled and leg supports 20,20 removed if desired.

To use the present improvement, children are taught to lift up slightly on the handles 16,16, push (roll) the walker 8 forward and then walk to walker 8. This procedure is different from what children did in the past where they simply pushed and slid the walker forward. Several benefits are gained by patients using the invention of the present application. First, the walker is prevented from sliding away from a patient, thereby giving the patient self-confidence and confidence in the walker. Secondly, patients using the walker must stand upright and are forced to balance themselves while the walker is moved forward. Thus, two goals of therapy, i.e. upright posture and balance, are encouraged by use of the present invention. Also, use of this improvement discourages children from pushing the walker too far out in front of themselves and inviting slippage and/or a fall. The improvement is low cost, easily installed on existing walkers, and solves many problems of using existing walkers.

Although the present invention has been described with reference to preferred embodiments, workers skilled in the art will recognize that changes may be made in form and detail without departing from the spirit and scope of the invention.

What is claimed is:

1. In a walker of the type having a pair of laterally spaced rear support posts and aligning front support posts joined together to define a lateral space between the sets of support posts, handle means along the lateral sides of the walker and spaced rearwardly from the front of the walker, and wheels on the lower ends of the front support posts so that for operation a patient lifts up on the handle means to cause the rear posts to leave the support surface and the walker to roll forward on the wheels, the improvement comprising:

a pair of auxiliary leg members;

adjustable means for attaching each auxiliary leg member to one front support post positioned to the rear of the wheels so that when the leg members and the rear support posts rest on a support surface the wheels on the front support posts are spaced from the support surface and upon lifting up on the handle means a short distance the wheels engage the support surface and the leg members and rear support posts clear the support surface.

2. A walker as claimed in claim 1 wherein the adjustable means comprises a clamp having a section secured to the leg and clamped to the respective front post.

3. A walker as claimed in claim 1 wherein the leg member includes a top portion parallel to the front post on which it is attached and a bottom portion bent away from the front support post and substantially perpendicular to the support surface so that the leg member will not interfere with the rolling motion of the walker nor the patient's feet.

4. A walker comprising:

a U-shaped frame member having an upper cross bar and terminating in a pair of spaced rear posts at the lower end thereof;

a front post pivotally connected to each rear post, terminating at their upper ends in a handle and having wheel means mounted on the lower end, the frame member and front posts defining a space for a person to stand with one rear post and one front post to each side of the person, and a support leg removably secured to each front post, said support legs being positioned on said front posts so that said wheel means on each front post is slightly spaced from a support surface when the support legs and the rear posts rest of the support surface for stably supporting a patient using the walker, whereby upon a slight lift of said handles, the walker tilts so that said wheel means engages said support surface and said rear posts and support legs are removed from contact with said support surface, thereby permitting the walker to be rolled along said support surface on said wheel means.

5. The apparatus of claim 4 wherein the handles substantially overlie the portion of the rear posts contacting a supporting surface, the support legs being substantially closer to the wheel means than to the rear support posts.

* * * * *